US008414039B2

(12) United States Patent
Liang et al.

(10) Patent No.: US 8,414,039 B2
(45) Date of Patent: Apr. 9, 2013

(54) SASH LOCK WITH SIGNAL

(75) Inventors: Luke Liang, South Plainfield, NJ (US); David Chen, Guangzhou (CN); Tong Liang, Guangzhou (CN)

(73) Assignee: Vision Industries Group, Inc.

( * ) Notice: Subject to any disclaimer, the term of this patent is extended or adjusted under 35 U.S.C. 154(b) by 1354 days.

(21) Appl. No.: 11/824,576

(22) Filed: Jun. 29, 2007

(65) Prior Publication Data

US 2008/0012357 A1 Jan. 17, 2008

Related U.S. Application Data

(60) Provisional application No. 60/817,612, filed on Jun. 29, 2006.

(51) Int. Cl.
*E05C 3/02* (2006.01)

(52) U.S. Cl. ..... 292/240; 292/DIG. 20; 292/DIG. 47

(58) Field of Classification Search ..... 292/332, 292/333, 335, 240–242, DIG. 7, DIG. 20, 292/DIG. 47; 49/181, 183, 185, 449
See application file for complete search history.

(56) References Cited

U.S. PATENT DOCUMENTS

| | | | | |
|---|---|---|---|---|
| 1,861,887 | A * | 6/1932 | Stassart | 292/334 |
| 4,923,233 | A * | 5/1990 | Daily | 292/332 |
| 6,045,169 | A * | 4/2000 | Frolov | 292/332 |
| 6,389,855 | B2 * | 5/2002 | Renz et al. | 70/107 |
| 6,722,710 | B2 * | 4/2004 | Cowper | 292/137 |
| 7,182,374 | B2 * | 2/2007 | Figge et al. | 292/334 |
| 7,731,251 | B2 * | 6/2010 | Ye | 292/163 |
| 2010/0207403 | A1 * | 8/2010 | Bourgoin et al. | 292/335 |

* cited by examiner

*Primary Examiner* — Carlos Lugo
*Assistant Examiner* — Mark Williams
(74) *Attorney, Agent, or Firm* — Thomas A. O'Rourke; Bodner & O'Rourke, LLP

(57) ABSTRACT

An automatic sash lock is disclosed having a housing with a top surface and a bottom surface and one or more side surfaces extending from said top surface. The housing has a front face at least a portion of which is open to the interior of the housing. The housing has a tongue movably secured thereto. The tongue has a retracted position and an extended position wherein the tongue extends from the open area of the front face of the housing. The tongue moves from a retracted position to an extended position when a portion of said housing contacts a keeper.

6 Claims, 29 Drawing Sheets

FIG

SASH LOCK WITH SIGNAL

This application claims priority on U.S. Provisional Patent Application Ser. No. 60/817,612 filed Jun. 29, 2006 the disclosures of which are incorporated herein by reference.

FIELD OF THE INVENTION

The present invention relates to an improved automatic sash lock and sash lock with a signal mechanism for determining whether a sash lock is in a locked position or an open configuration.

BACKGROUND OF THE INVENTION

Sash locks are very common on double hung windows. In many locations such as homes and businesses, the windows may be opened at certain times of the day or evening for ventilation or natural cooling and later closed. As a security measure, these windows are usually locked when people are alone in their homes or when the establishment is closed.

Since many buildings have a number of windows, it can be a chore and quite time consuming to individually check each window to make sure it is locked. As a result, there have been several indicators that provide a signal to the user to notify the user whether the window is locked. One such sash lock is disclosed in U.S. application Ser. No. 10/932,883 filed Sep. 2, 2004, the disclosures of which are incorporated herein by reference. This lock uses a flag which can be raised or lowered to signal whether the window is in a locking condition. Another sash lock is disclosed in U.S. Ser. No. 11/254,065 filed Oct. 19, 2005, which discloses a sash lock with a housing. The housing has a status indicator in the housing that permits a user to determine if the window is in an unlocked condition. The sash lock in that application has a color indicator to inform the user of the status of the lock.

OBJECTS OF THE INVENTION

It is an object of the present invention to provide an improved locking mechanism for a sash lock.

It is another object of the invention to provide a sash lock with an automatic locking feature.

It is also an object of the invention to provide a sash lock that locks when a trigger contacts the keeper used with the lock.

It is another object of the present invention to provide an improved indicator for a sash lock that provides a visual indication whether a sash lock is in a locked position or an unlocked position.

It is another object of the invention to provide a combination lock and keeper that coact to signal the status of the sash lock.

It is a still further object of the invention to provide a sash lock with a unique visual indicator for determining whether a sash lock is in a locked configuration or an unlocked configuration.

SUMMARY OF THE INVENTION

The sash lock of the present invention includes a housing and a separate base or protective member. The housing has a top surface and bottom surface. Extending from the top surface are a pair of side walls. The housing also has a front face and a rear face. At least a portion of the front face is open to permit a tongue to extend therefrom to secure the lock to a keeper. The open front face may have a hood that extends outwardly that may be adapted to receive a keeper so that the keeper is hidden by the top surface or hood of the housing. Alternatively, the housing has a top surface where the hood does not extend over the keeper. There is a locking mechanism that secures the sash lock to the housing. The locking mechanism is preferably an automatic one in which the sash lock becomes locked automatically when a portion of the keeper is contacted. In a preferred embodiment, the locking mechanism has a tongue that has a retracted position when the lock is in an unlocked configuration and an extended position when the lock is in a locked configuration. The tongue is preferably spring driven from the retracted position to the extended position. In the preferred embodiment, the tongue is released from the retracted position to the extended position by means of a trigger.

The tongue may be generally rectangular in cross section with a top surface and a pair of side surfaces. The bottom of the tongue may be open and receive a spring that provides a force causing the tongue to extend when the tongue is released by the trigger. The tongue extends from an open portion of the front face of the housing when in an extended position and is generally flush with the front face or slightly recessed when the tongue is retracted. The tongue remains in its recessed position until activated by a trigger. The trigger may be a pin or other suitable trigger means that extends outwardly from the front face of the housing and can contact the keeper of the window sash to release the tongue. When the trigger contacts the keeper, the tongue is released and the tongue extends to a locking position.

The keeper has a top surface, a front wall and a rear wall. Connecting the front and rear walls are a pair of end walls. The top surface typically has one or more orifices for securing the keeper to a sash. Screws or other securing means can be used to secure the keeper to a sash. The top surface and/or the front surface of the keeper may have an open area for receiving a a locking tab that extends from the underside of the top surface of the sash lock housing, i.e. below the bottom surface of the sash lock housing. When the sashes of the window to be locked are approaching a closed arrangement, the trigger such as a tab on the sash lock is positioned in the open area of the keeper. As the sash lock and keeper are positioned in a locking arrangement when the window closes, the keeper hits the trigger and the tongue is forced out by the spring. Alternatively, the trigger hits the keeper thus forcing the tongue to extend from the housing into a locking position. The tongue may extend into a recessed area in the front wall of the keeper whereby it prevents the sashes from being separated until the tongue is retracted back into the housing. The extended tongue and the tab on the sash lock housing hold the sash lock to the keeper and retain the windows in a locked condition.

In a preferred embodiment of the present invention, the tongue is connected to a pull tab. The pull tab permits a user to unlock the sash lock by retracting the tongue into its recessed, loaded position. The pull tab preferably has a handle portion so that a user's hands can more easily grasp the pull tab. The pull tab may have portion thereof where there is a signal means to signal whether the tongue is in a retracted or unlocked condition or extended in a locked arrangement. Preferably, a rear surface of the pull tab has a signal means. When the tongue is in an extended position, i.e. a locking position, the signal means reflects that position. The signal means shows that the tongue is in a recessed condition when the pull tab has been pulled back. Preferably the signal means is red when the lock is in an unlocked position. When the lock is in a locked position, the signal means will reflect another color.

DETAILED DESCRIPTION OF THE DRAWINGS

Figure 12B:
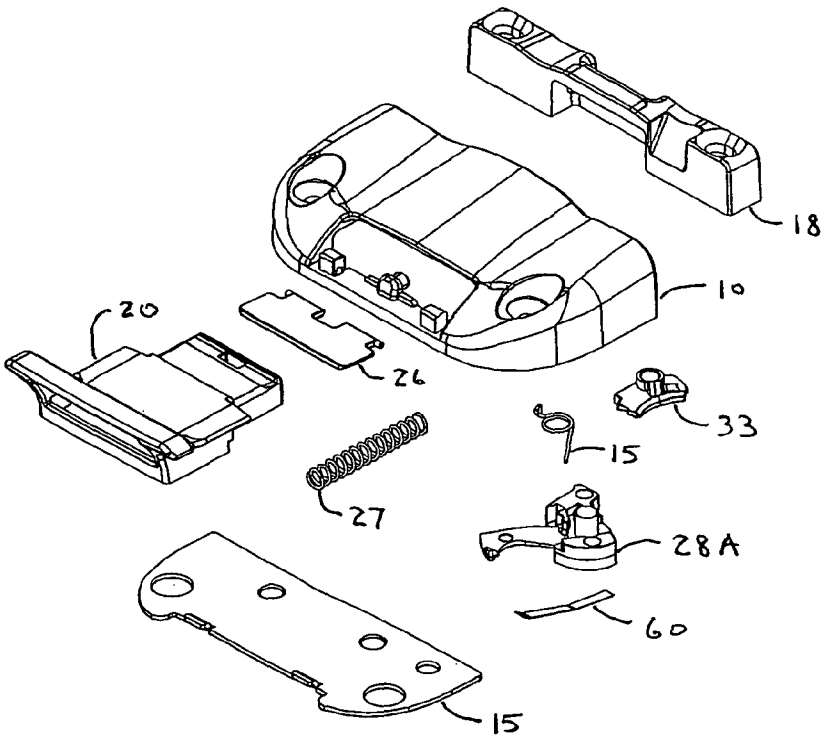
FIG. 12B is an exploded top view of the sash lock of FIG. 12A.
Figure 12A:
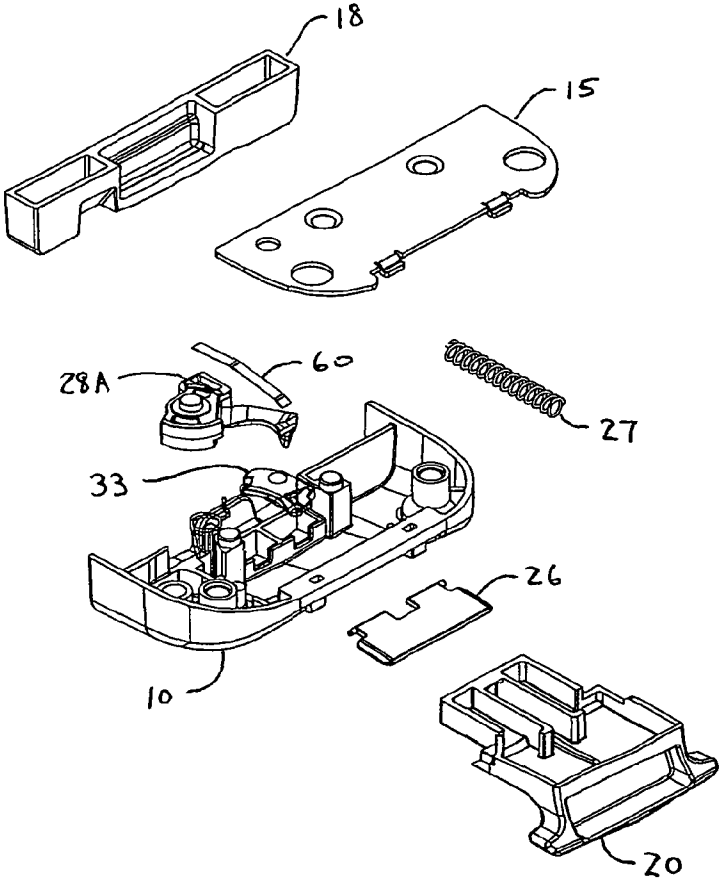
FIG. 12A is an exploded view of the bottom of an alternate embodiment of the sash lock and keeper of the present invention.
Figures 13A, 13B:
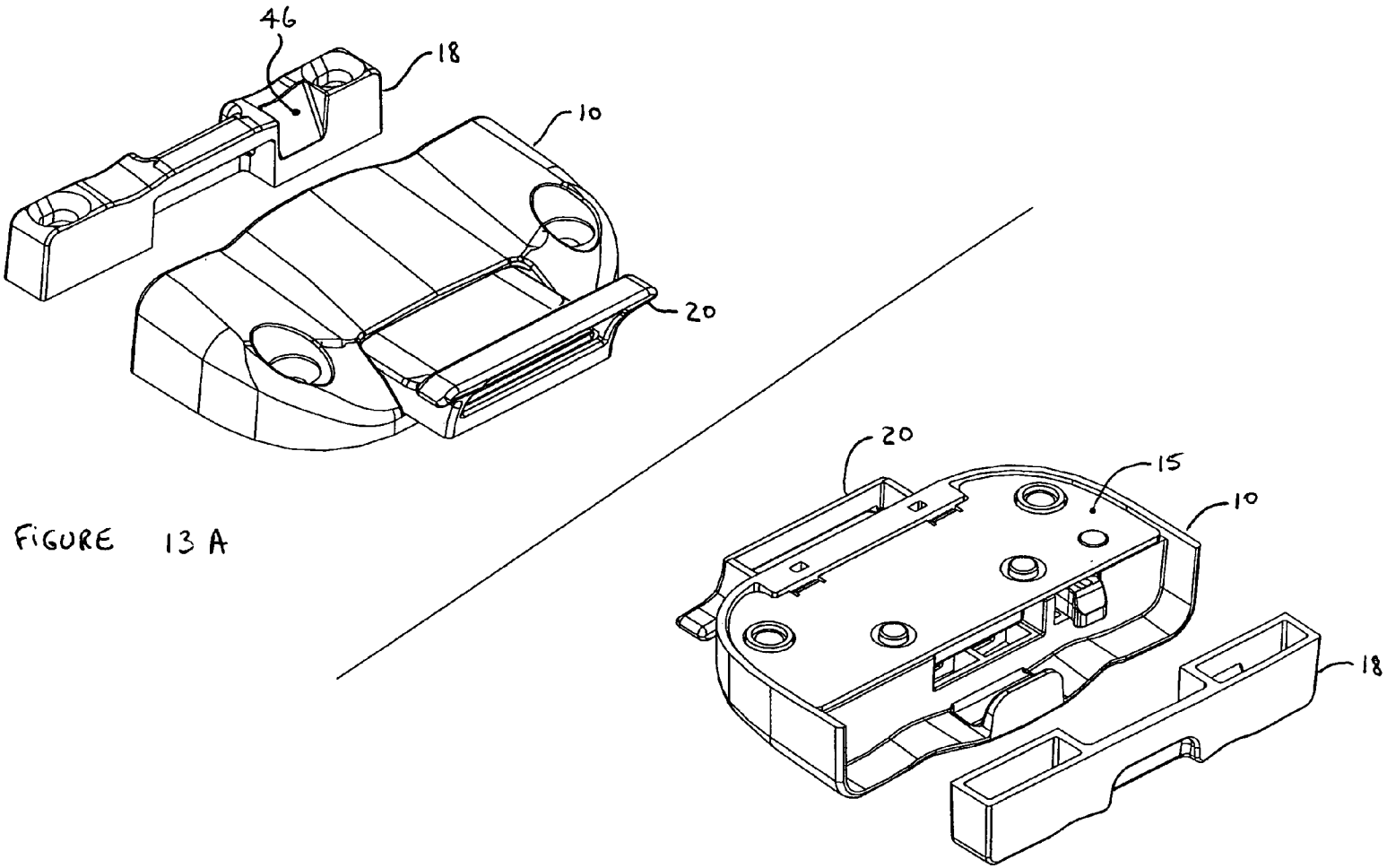
FIGS. 13A and 13B are perspective views of the top and bottom of the sash lock and keeper of FIG. 12.
Figure 14A:
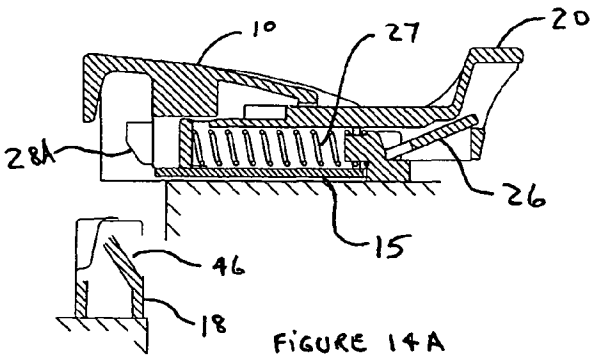
Figure 14B:
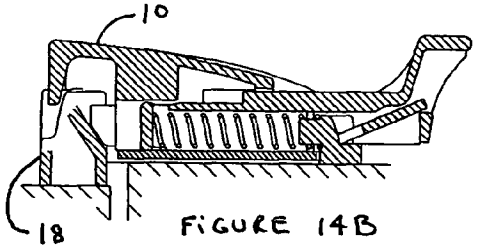
Figure 14C:
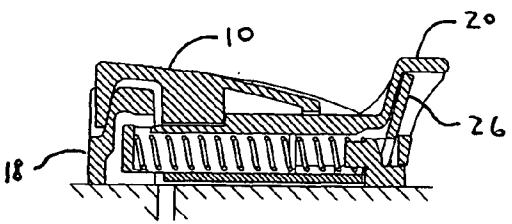

FIG. 14A-C show side view of the sequence of the operation of the sash lock and keeper of the embodiment shown in FIG. 12 as a sash lock on a sash is moving into contact with the keeper.

Figure 15A:
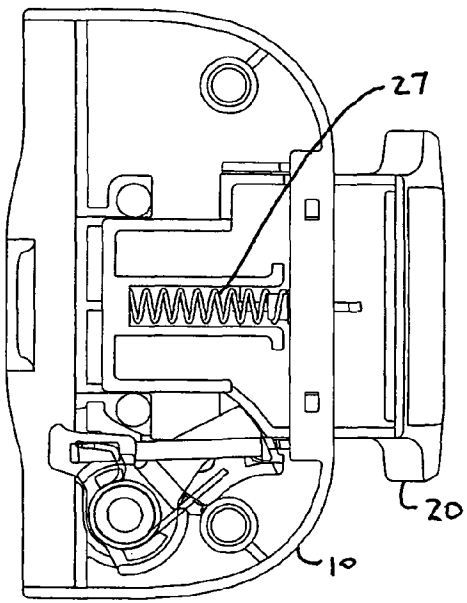
Figure 15B:
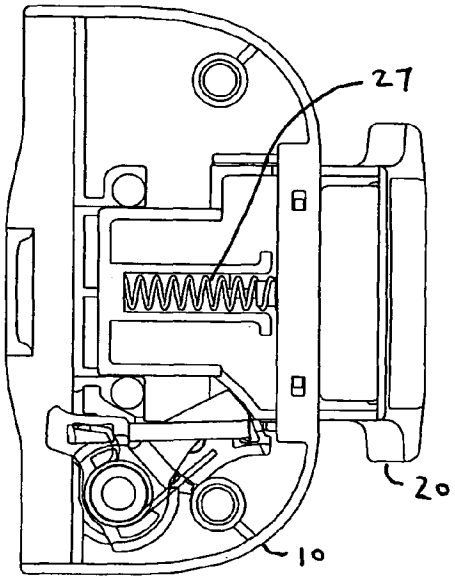
Figure 15C:
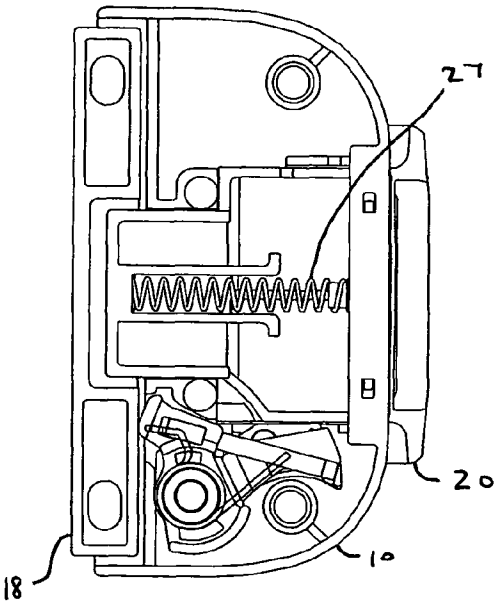

FIG. 15A-C show bottom view of the sequence of the operation of the sash lock and keeper of FIG. 14A-C as a sash lock on a sash is moving into contact with the keeper.

DETAILED DESCRIPTION OF THE INVENTION

Figure 1:
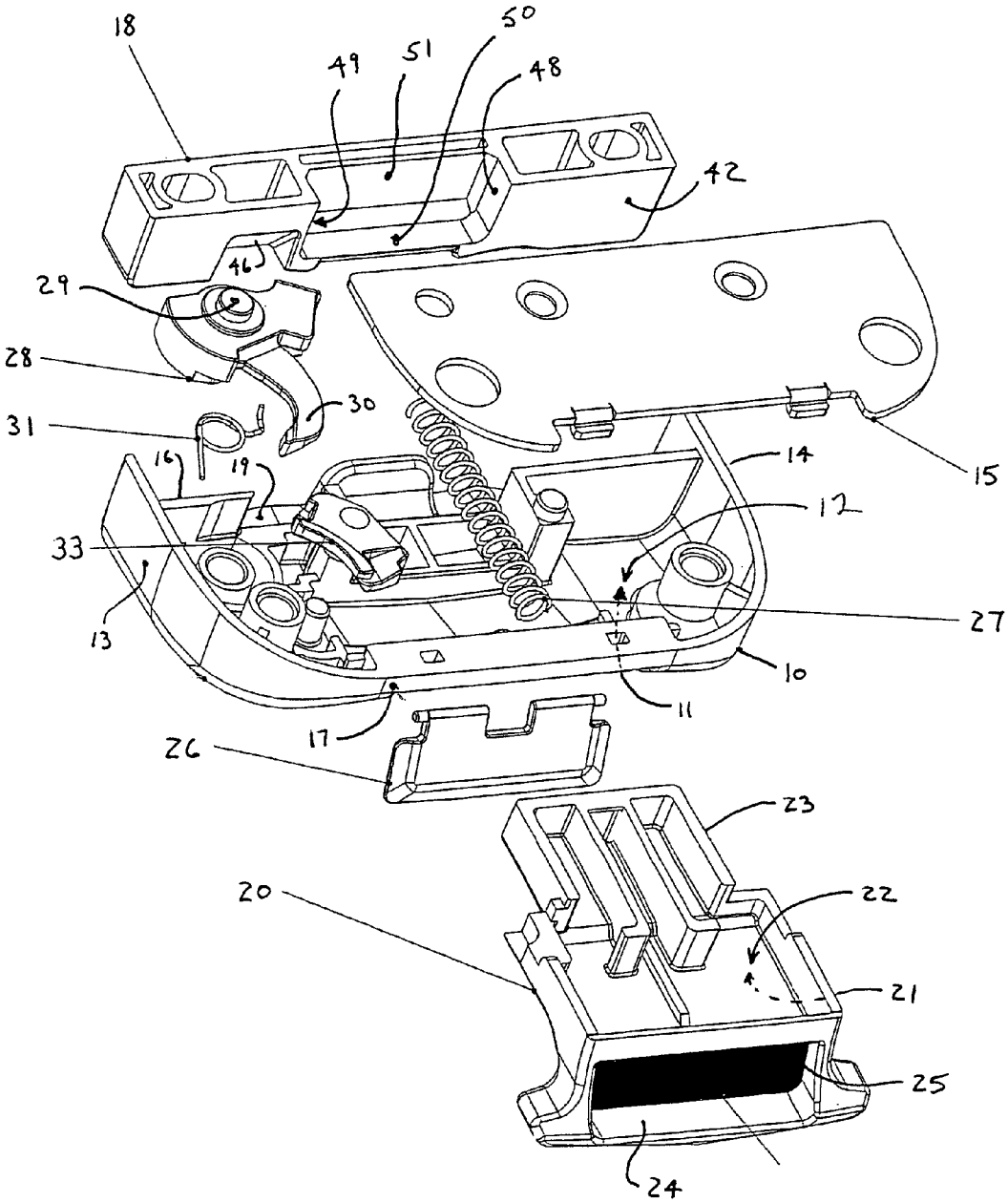
FIG. 1 is a perspective exploded view of the sash lock and keeper of the present invention.
Figure 1A:
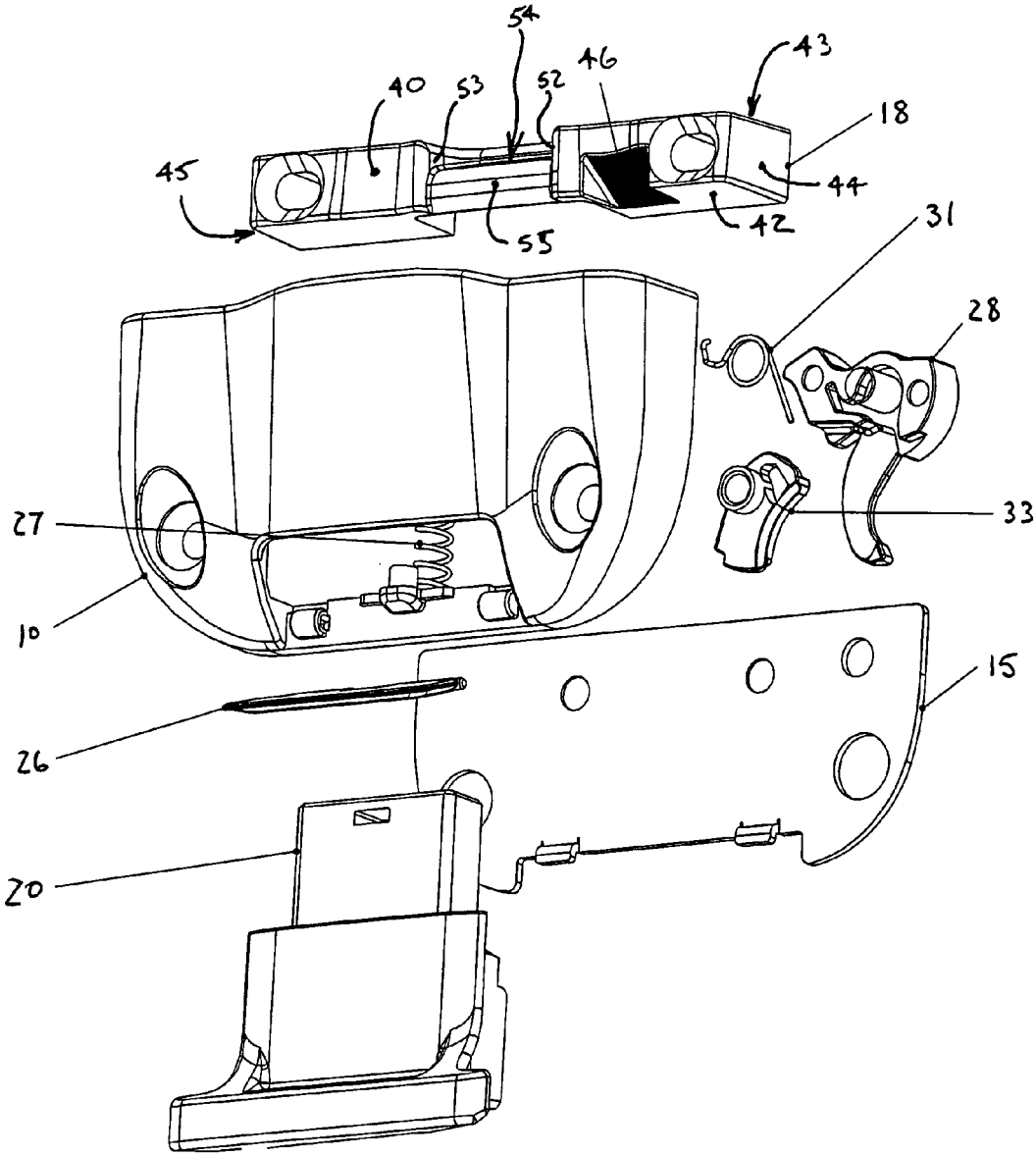
FIG. 1A is a top exploded view of the sash lock and keeper of the present invention.
Figure 1B:
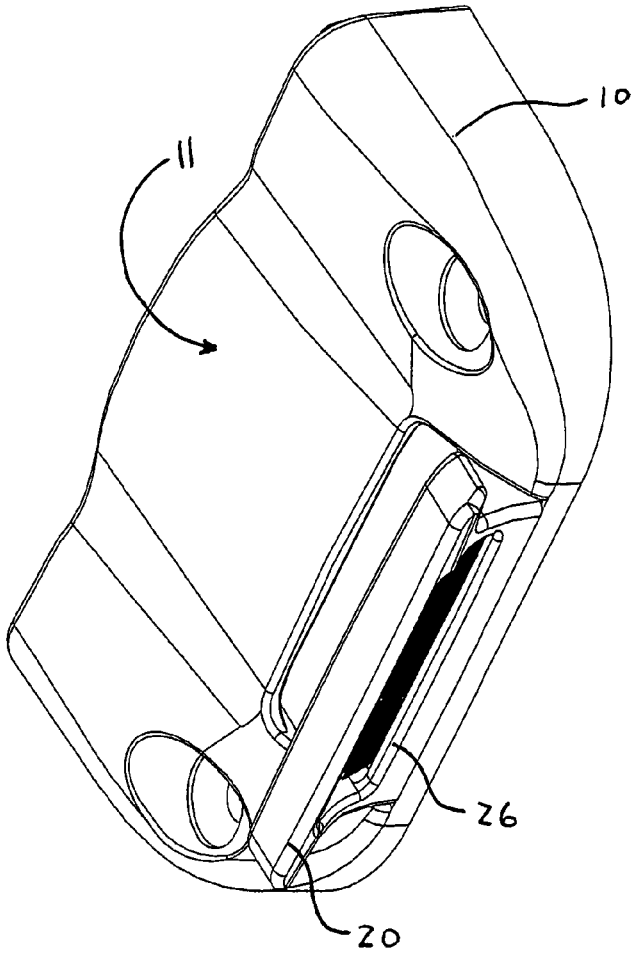
FIG. 1B is a bottom exploded view of the sash lock and keeper of the present invention.
Figure 1C:
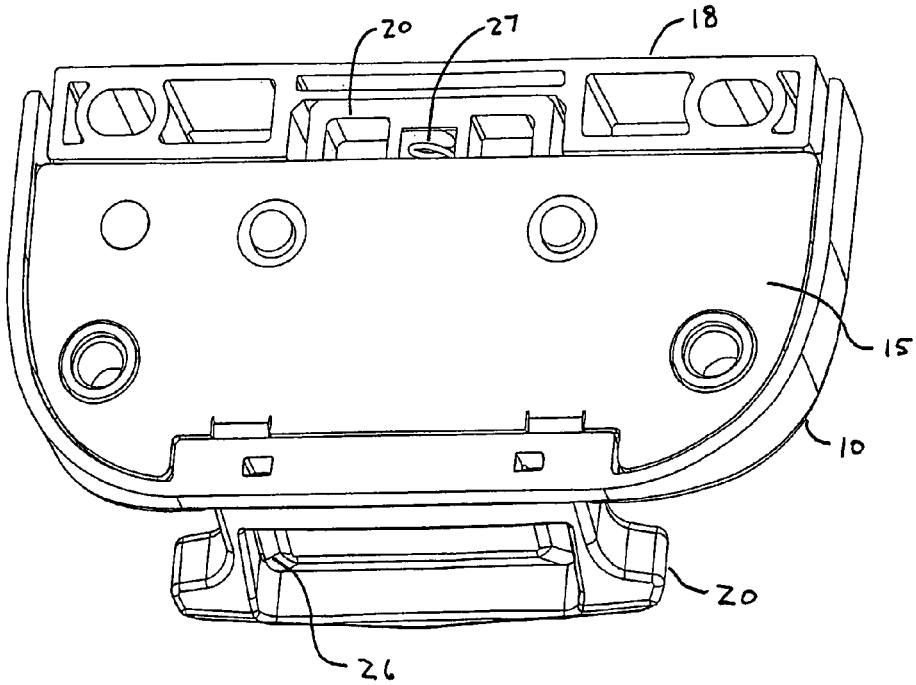
FIG. 1C is an underside view of the sash lock of the present invention.
Figure 2:
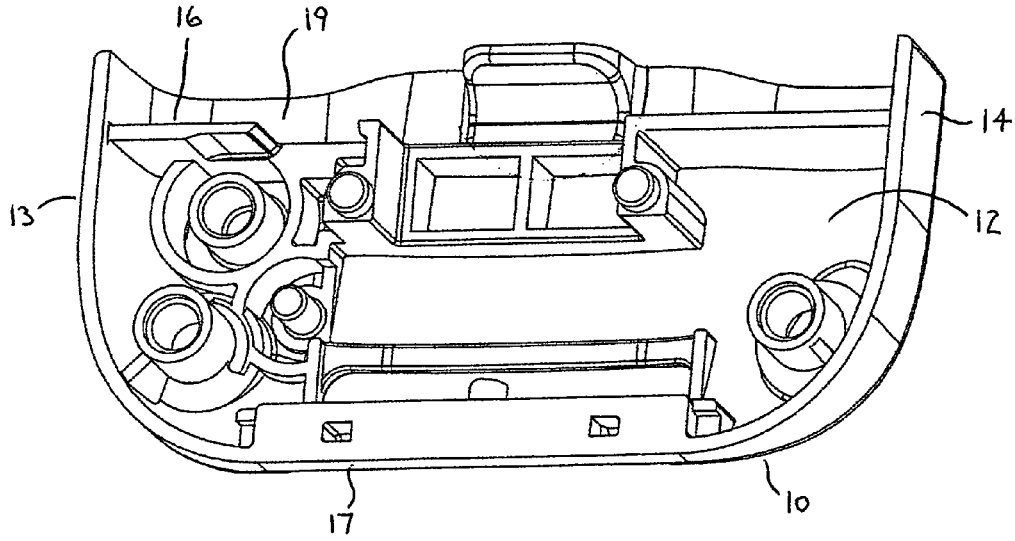
FIG. 2 is an underside view of the housing of the present invention.

FIG. 1 shows a housing 10. The housing 10 has a top surface 11, a bottom surface 12 and a first sidewall 13 and a second sidewall 14. The housing may have a variety of shapes as may be desired by a user. There can be base plate 15 that protects the mechanism from dust dirt and or damage during for example, installation. There is a front face 16 and a rear face 17 of the housing. The top surface 11 of the housing may extend over the keeper 18 and form a hood 19 over the keeper 18. Alternatively, there is no hood over the keeper and the lock and keeper are visually separate. The mechanism includes a pull tab 20. The pull tab can be used to "load" the lock, i.e. to activate the lock so that when the trigger contacts the keeper a spring causes the lock to extend into the keeper to prevent the sashes from separating. The pull tab 20 has a top surface 21 and a bottom surface 22 as well as a tongue 23 and a handle 24. The bottom surface 22 is preferably open although the top surface 20 may be open as well or alternatively the bottom surface may be closed and the top surface open. The pull tab 20 has an end surface 25 which may include a visual indicator 26 to indicate whether the tongue 23 is in a locked position or an unlocked position. The visual indicator 26 may include a color indicator which shows one color when the tongue is in a retracted position and another color when the tongue is in an extended position. Other visual indicators such as words, letters or other symbols may be used as well.

Figure 10A:
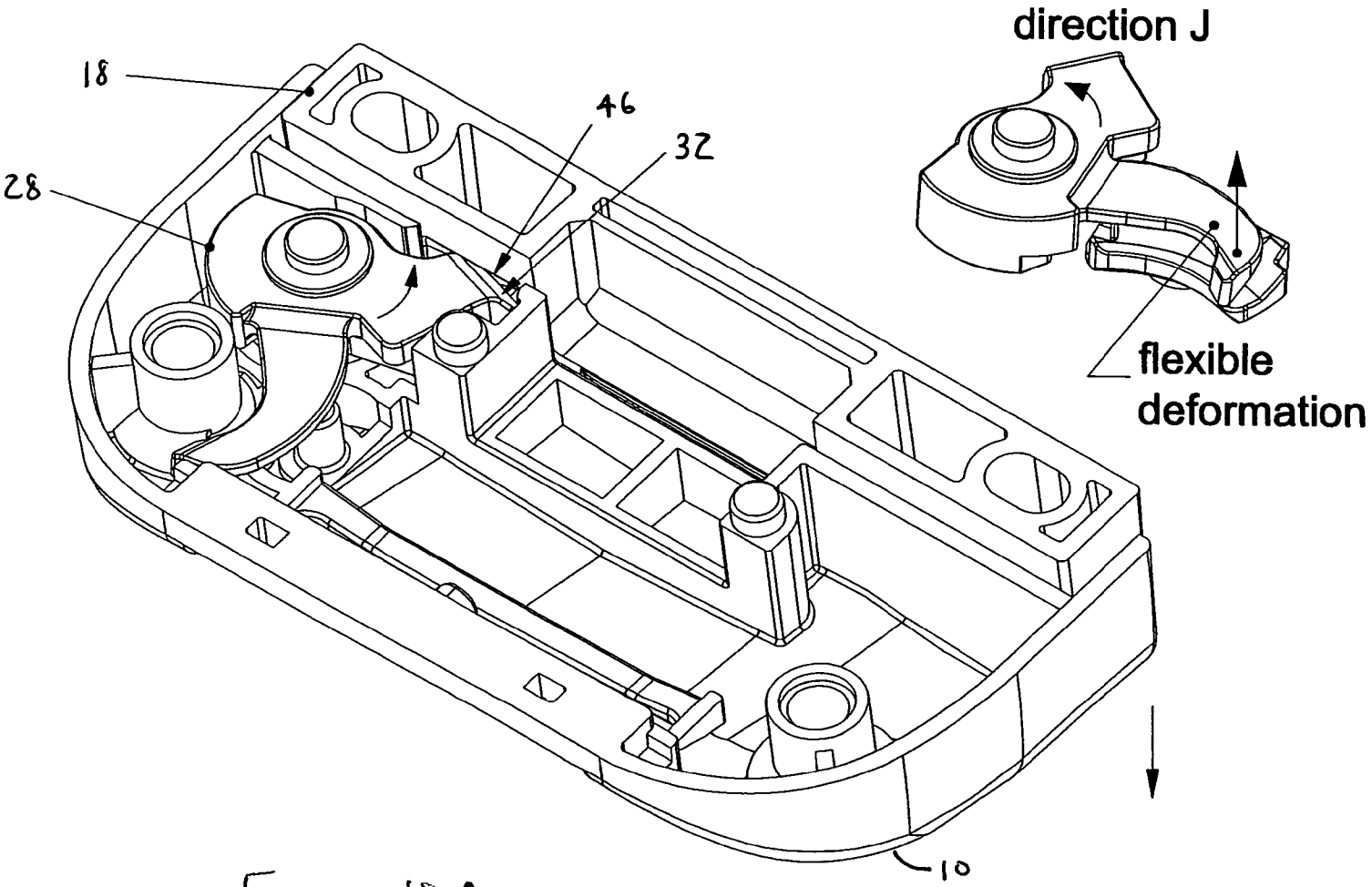
FIG. 10A is a perspective view of the housing with the activator arm present and in a retracted position.
Figure 10B:
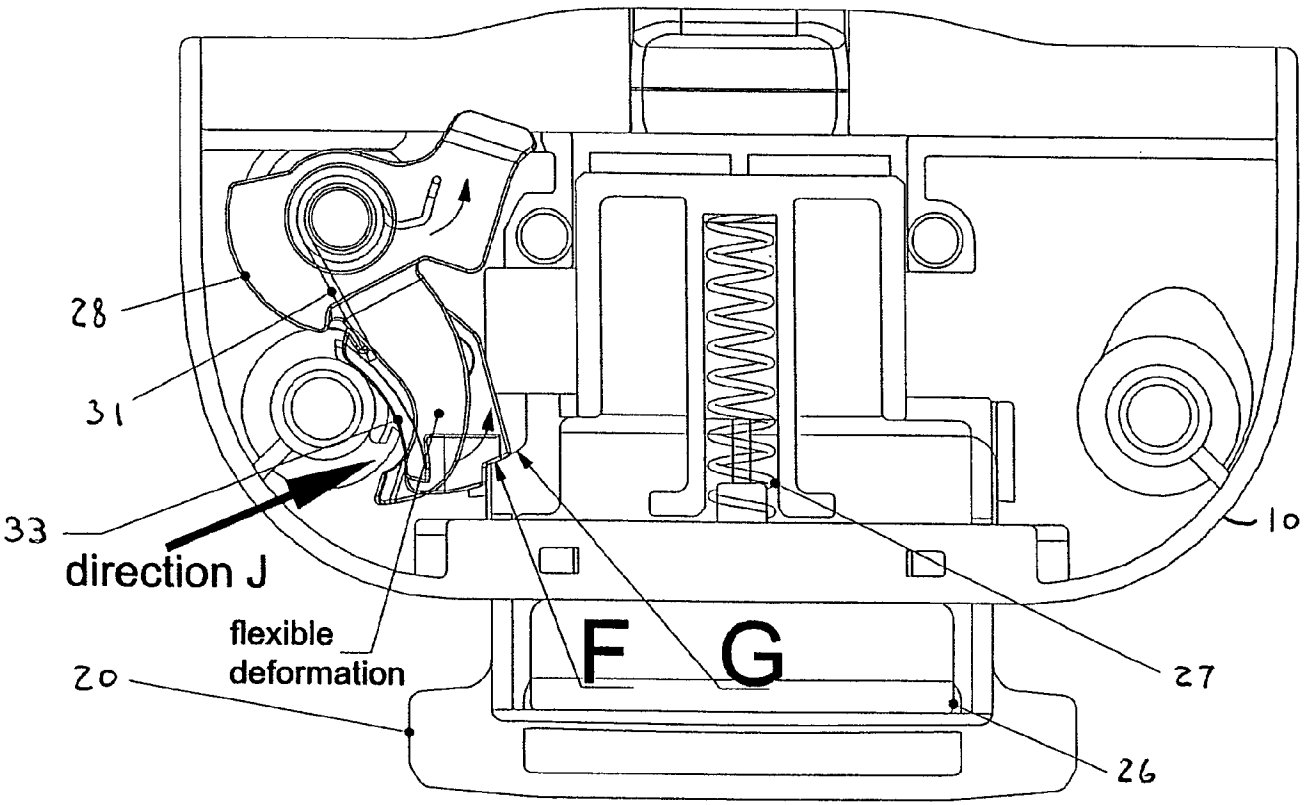
FIG. 10B is a top view of the underside of the housing with the activator and the tongue in a retracted position and the trigger recessed.

In operation, a user pulls the tab outwardly from the housing. The tab is locked in this "activated" position and remains there until the keeper is contacted by the trigger. A spring 27 forces the pull tab 20 into an extended position when the pull tab 20 is released by the trigger 28. The trigger 28 is above an activator arm 33 and includes a stem 29, such that the trigger pivots on the stem. The stem has a spring 31 thereon that forces the trigger into an extended position when the tongue is released. The activator arm is held in the activated position by being retained against a portion of tongue 23 (see "F" in FIG. 10B) by torsion spring 31.

Figure 7A:
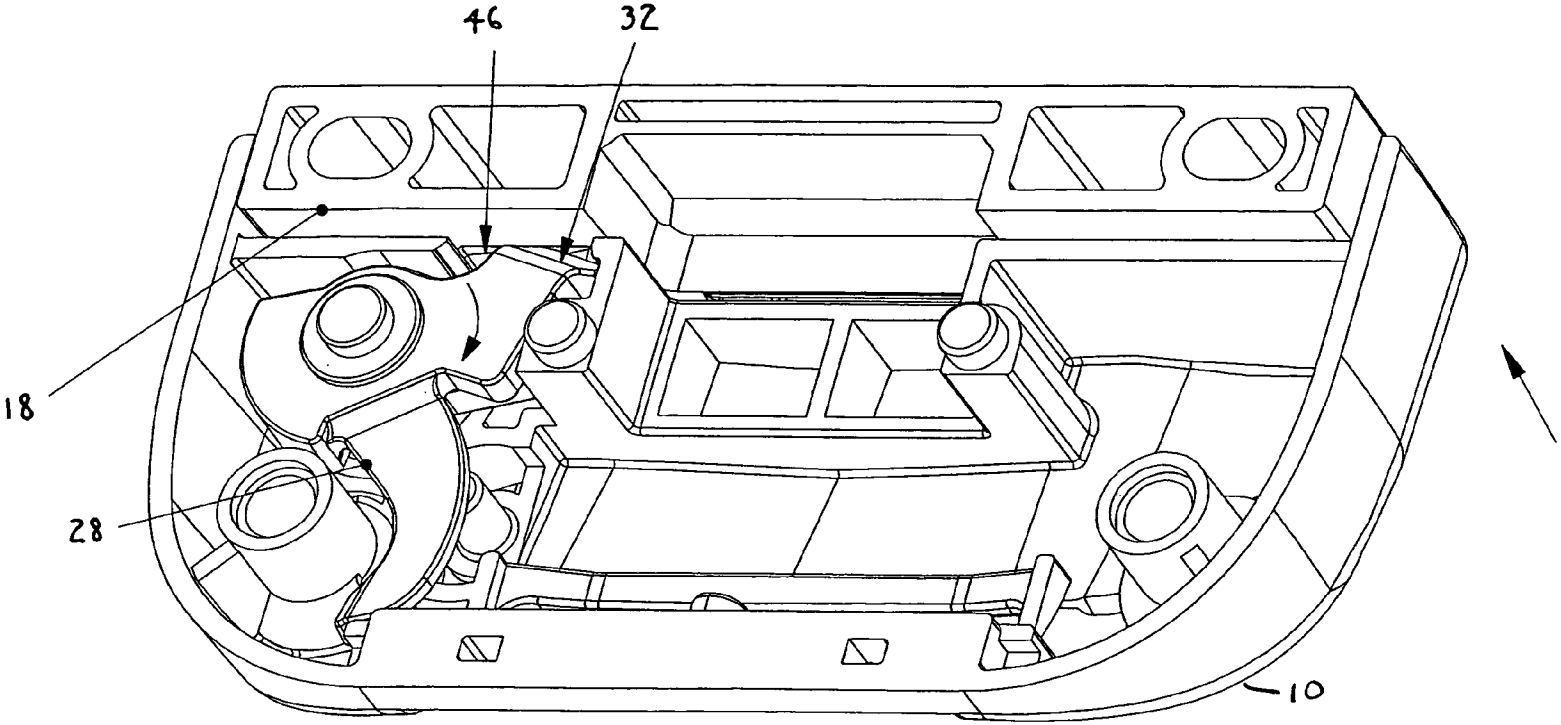
FIG. 7A is an underside view of the housing.
Figure 7B:
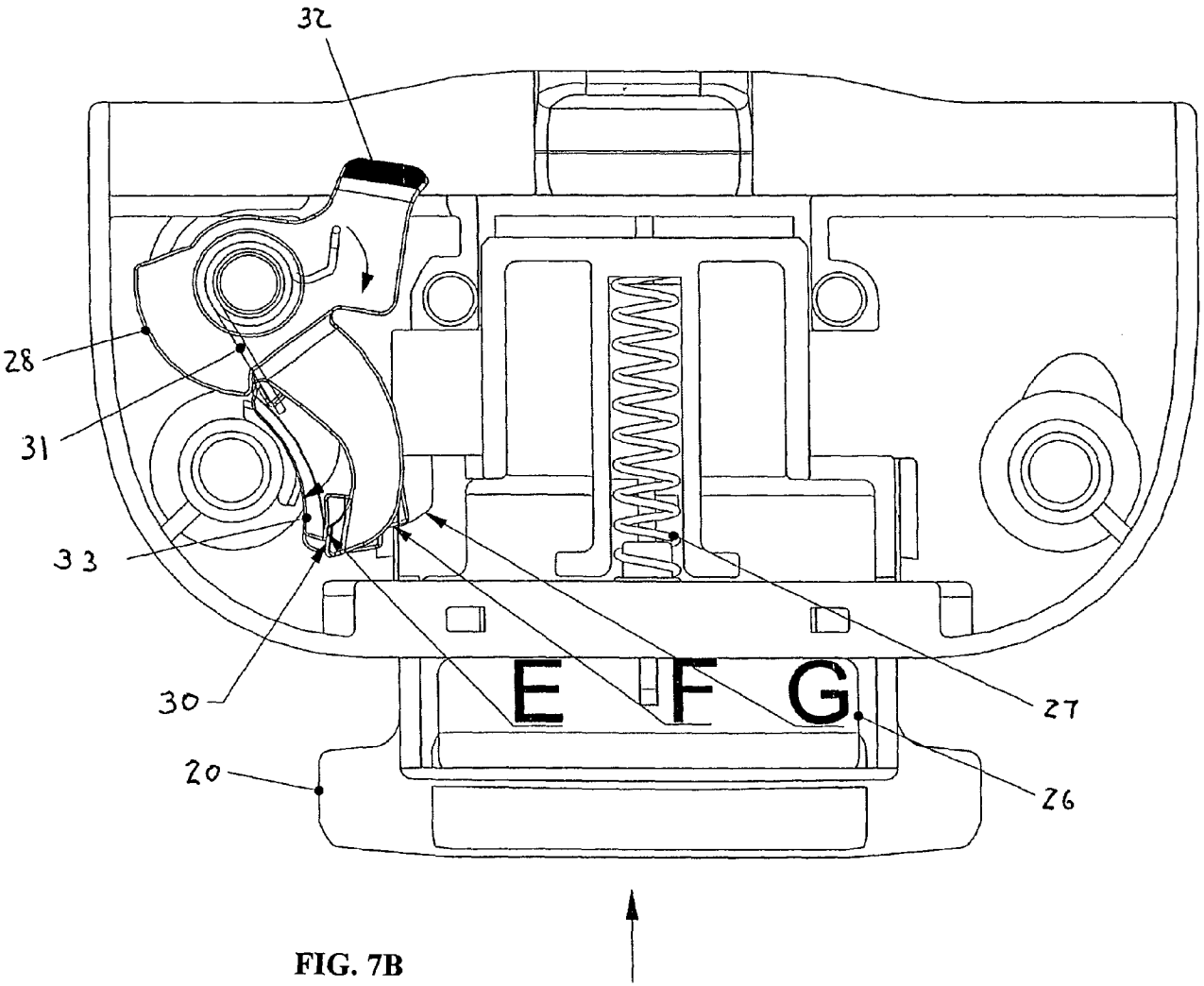
FIG. 7B is an underside view of the housing with the components in place and the tongue in an extended position.
Figure 8A:
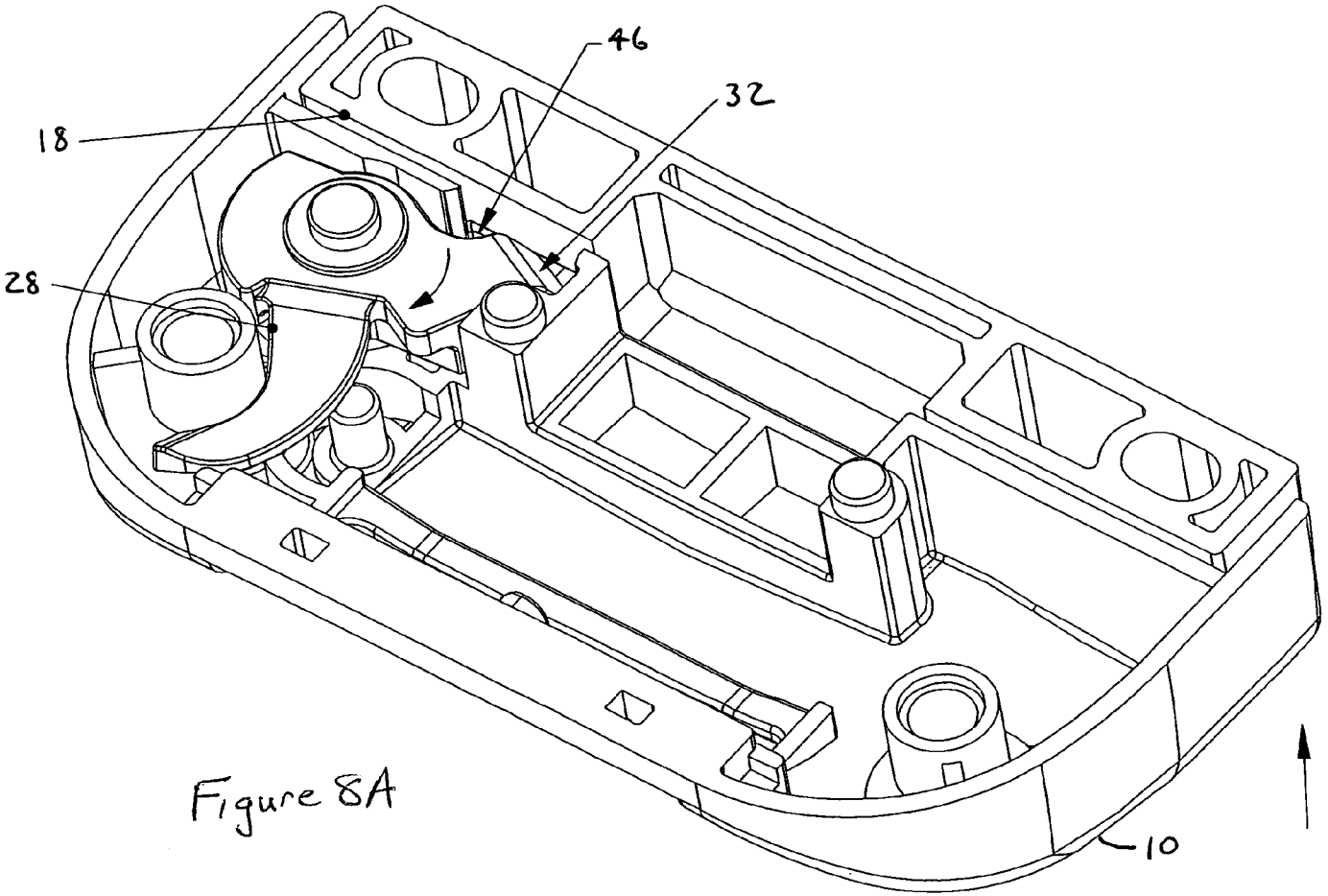
FIG. 8A is an underside view of the housing.
Figure 8B:
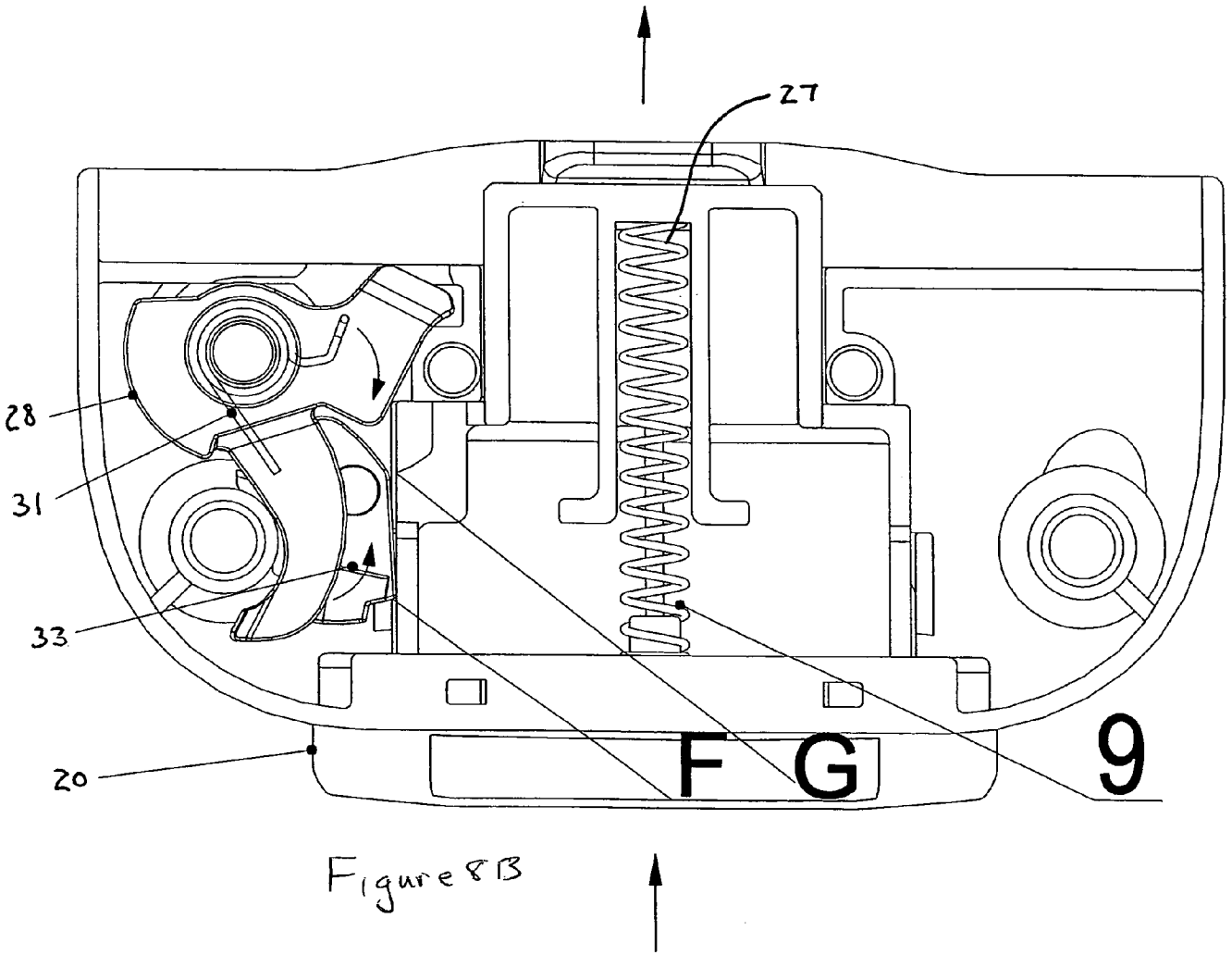
FIG. 8B is an underside view of the housing with the components in place and the tongue in an unlocked position
Figure 9A:
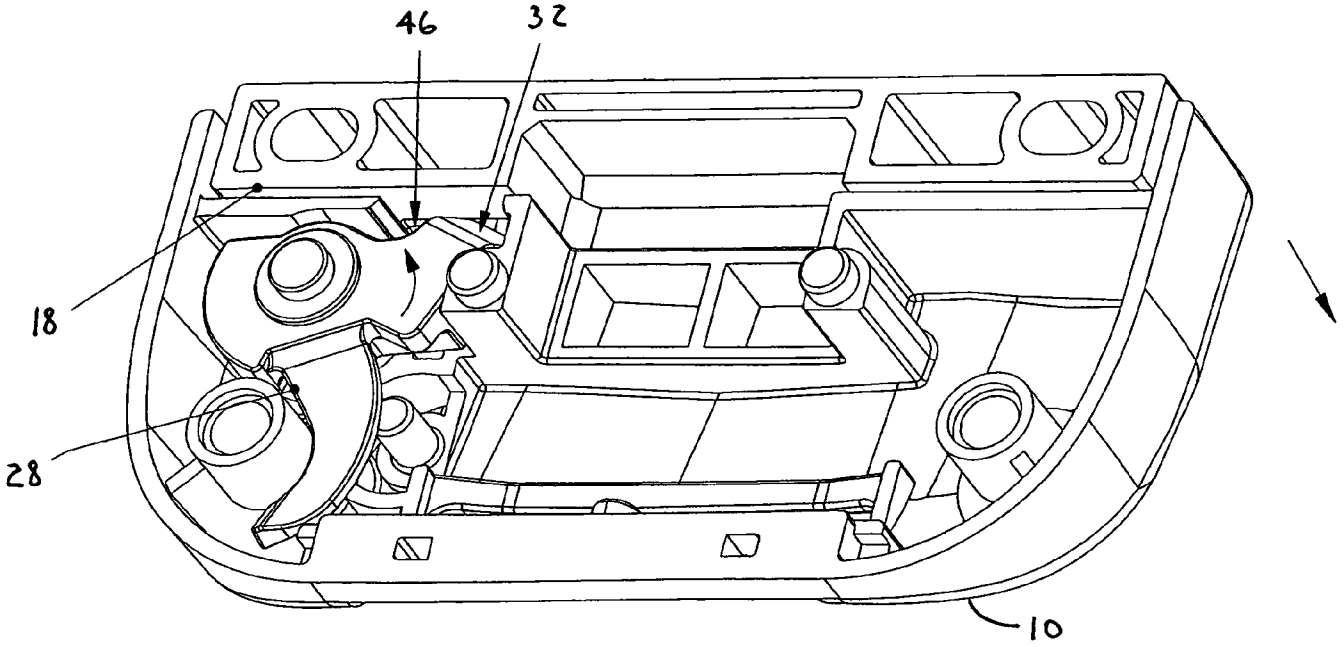
FIG. 9A is a perspective view of the underside of the housing with the activator arm present and in an extended position.
Figure 9B:
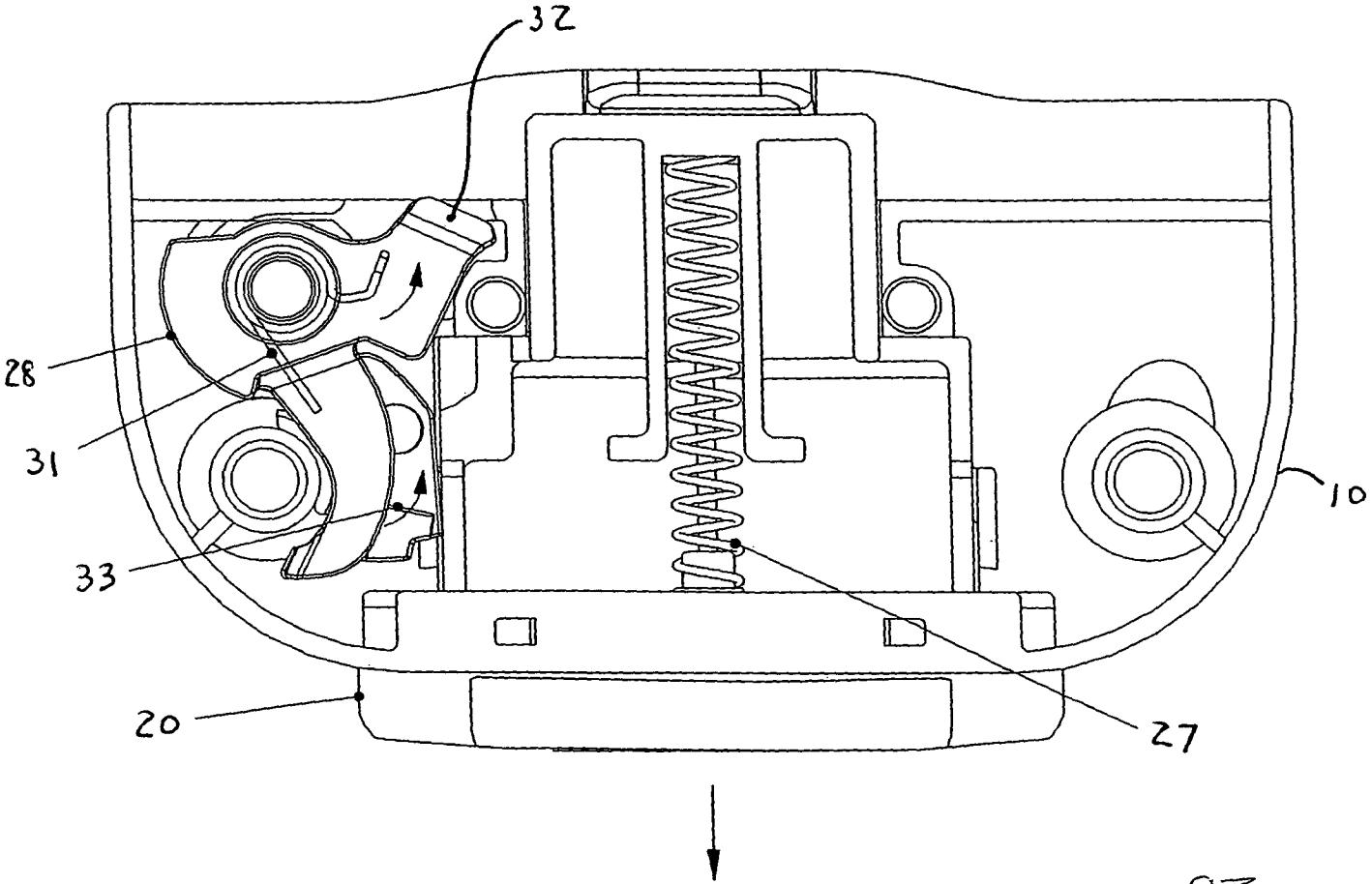
FIG. 9B is a top view of the housing with the activator arm and tongue in an extended position.
Figure 9C:
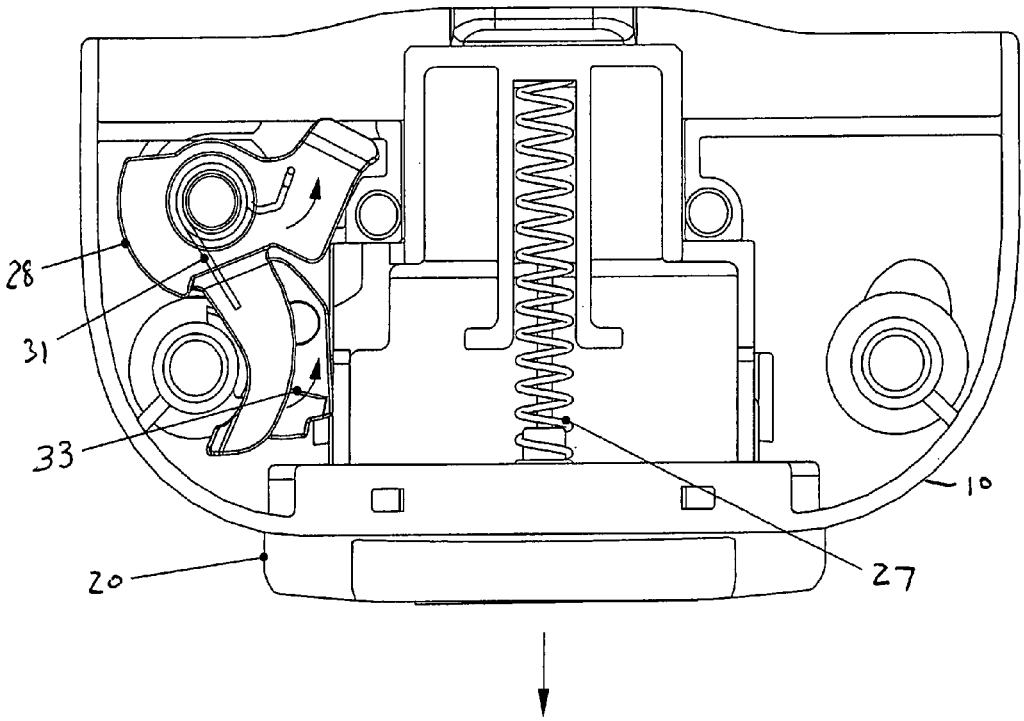
FIG. 9C is a top view of the housing with the tongue in an extended position.
Figure 11A:
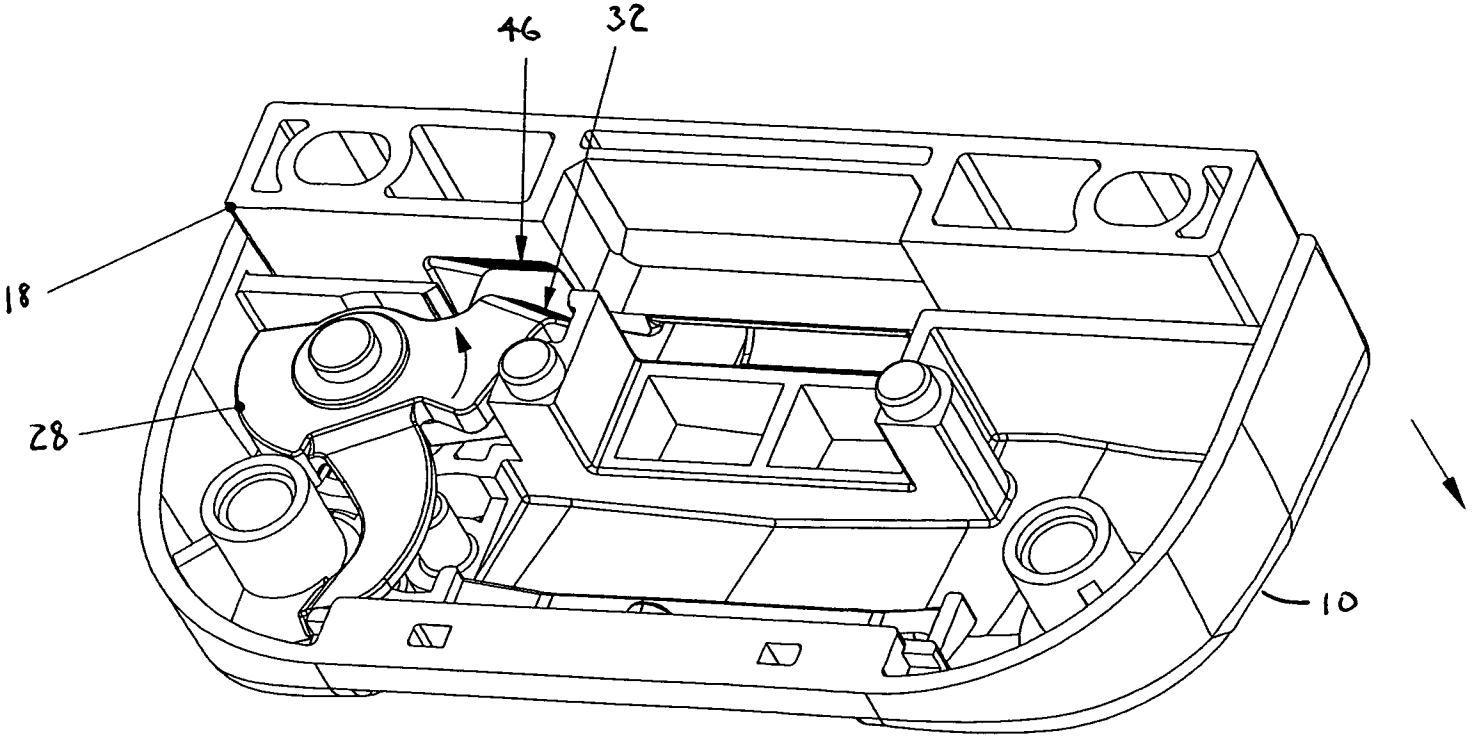
FIG. 11A is a perspective view of the underside of the housing with the trigger extended.
Figure 11B:
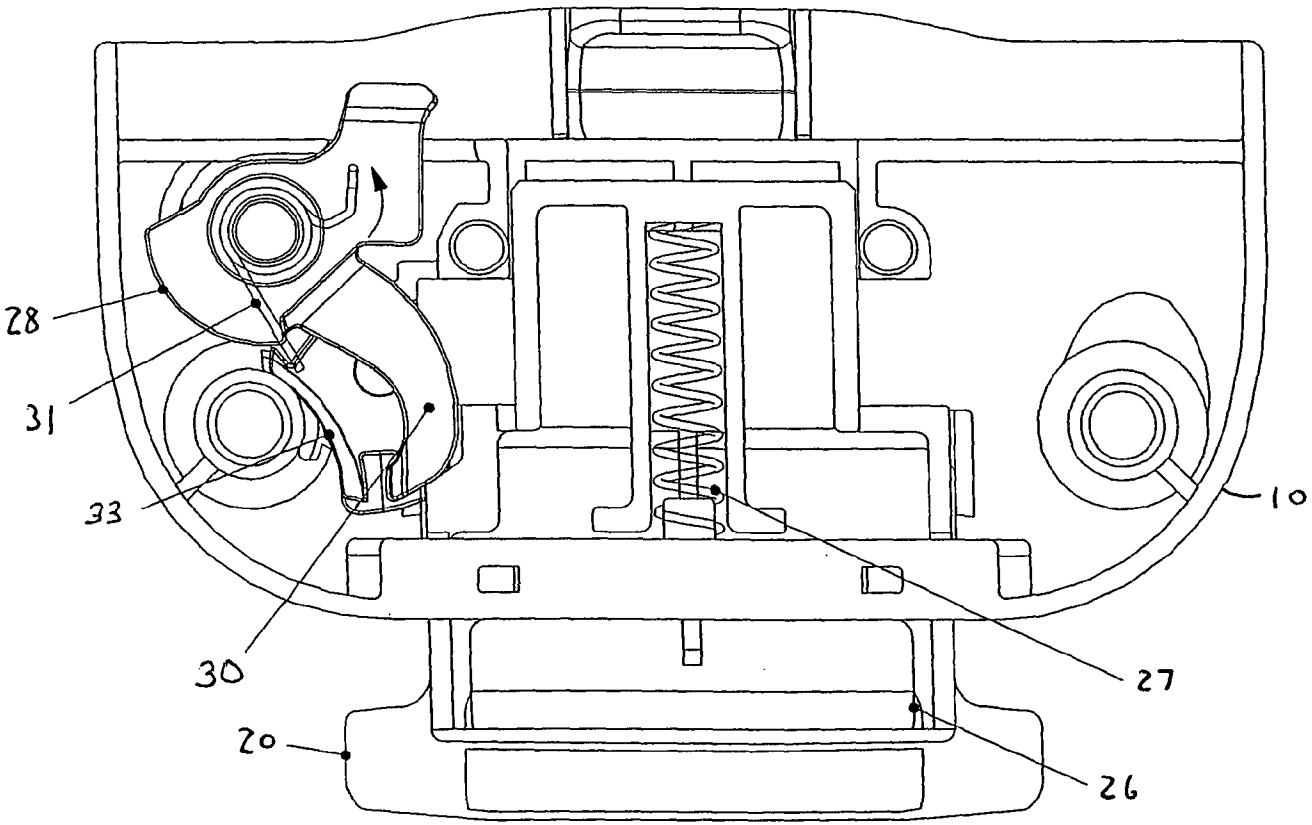
FIG. 11B is a top view of the housing with the activator and the tongue in a retracted position and the trigger is primed.
Figure 11C:
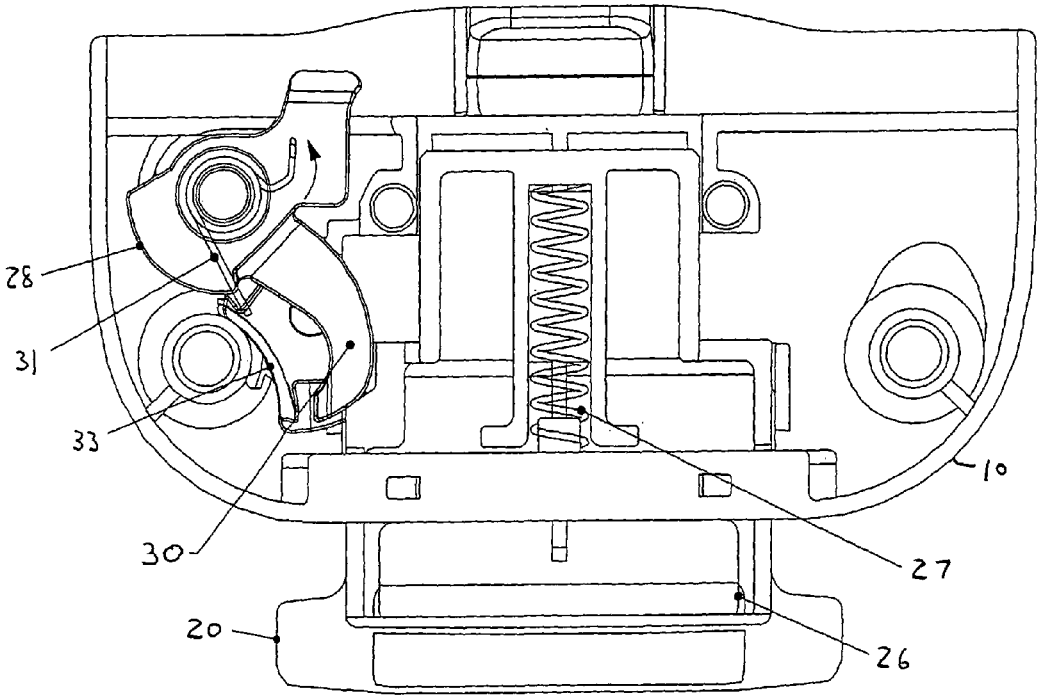
FIG. 11C is a top view of the housing with the tongue in a retracted position and where the trigger is primed.

When the window sash approaches a closed position, the keeper 18 on the sash hits the trigger 28 (see FIGS. 11 A and 10A) causing the engagement arm 30 of trigger 28 (see FIG. 1) to engage and catch upon a portion of activator arm 33 (see FIG. 7B), which releases the pull tab 20. When the pull tab 20 is released, the tongue is freed from the retracted position and extends outwardly to lock the keeper to the sash lock.

The keeper 39 has a top surface 40, a front sidewall 42 and a rear sidewall 43 A pair of end walls 44 and 45 join the sidewalls. The top surface 40 where it joins the front sidewall 42 has a portion that has a slanted wall surface 46 which provides a surface that contacts the surface 32 of trigger 28 (FIGS. 11A and 10A) when the sash of a window is closing. The slanted wall surface 46 forces the trigger 28 inwardly thus causing the trigger 28 to release the pull tab 20. As the pull tab 20 is released, the tongue 23 extends from its recessed position to its extended position. The keeper 39 has a recessed section in the rear sidewall 43. The recessed section has a first interior sidewall 48, a second interior sidewall 49, an interior top wall 50 and an interior back wall 51. When the trigger releases the tongue, the tongue extends outwardly from the front wall of the sash lock housing. The tongue and the interior top wall 50 prevent the sash of a window from being raised thus locking the sash. On the front sidewall 42 of the keeper and the top surface 40 there is a recessed section 51 which has a top recess section 53 and a sidewall recess section 52, a tab 54 on the underside of the housing contacts the recessed section 51 when the tongue is extended.

Figure 3:
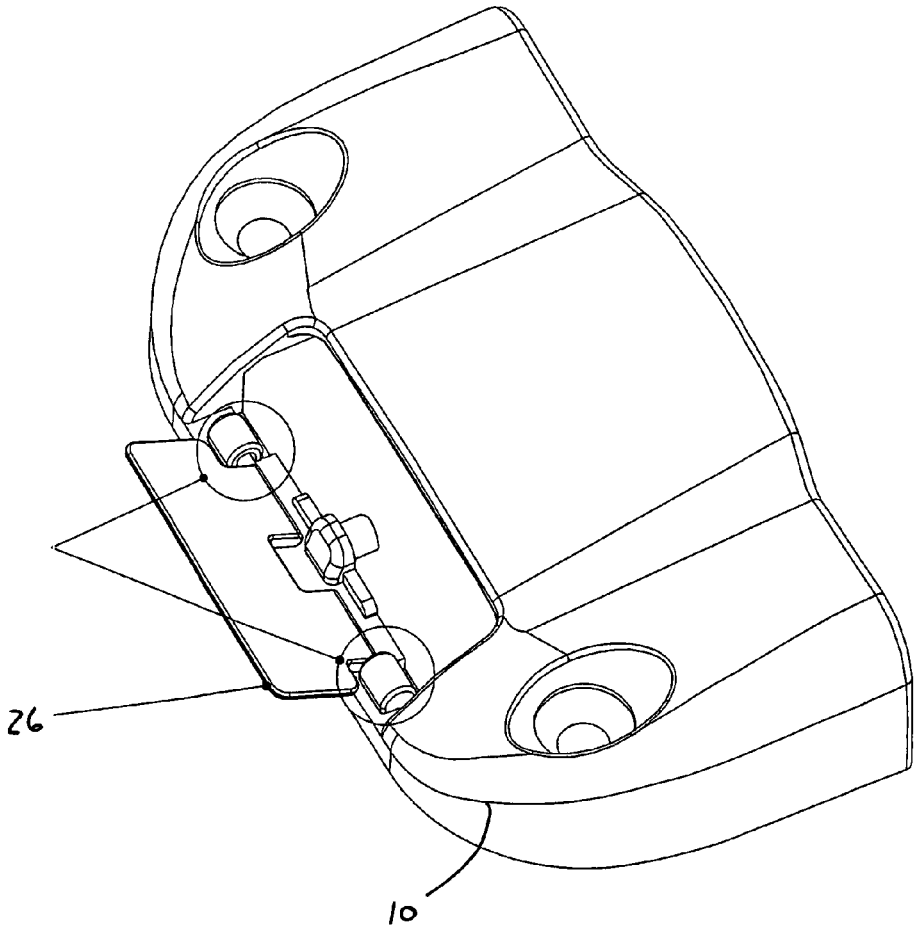
FIG. 3 is a top view of the sash lock housing.
Figure 4A:
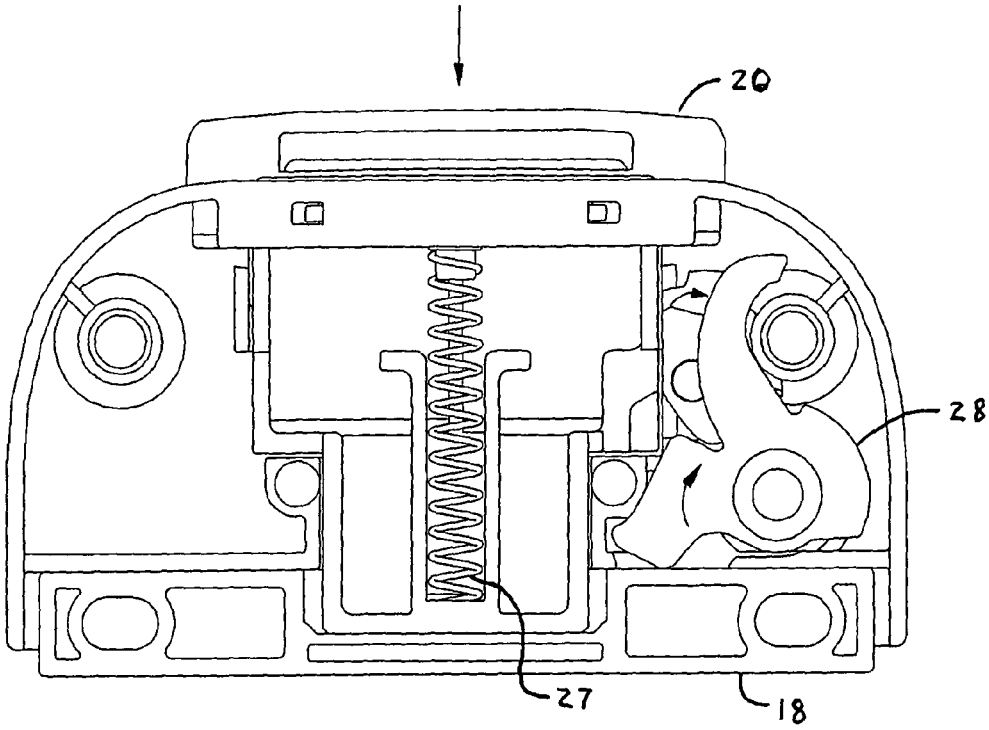
FIG. 4A is an underside view of the sash lock.
Figure 4C:
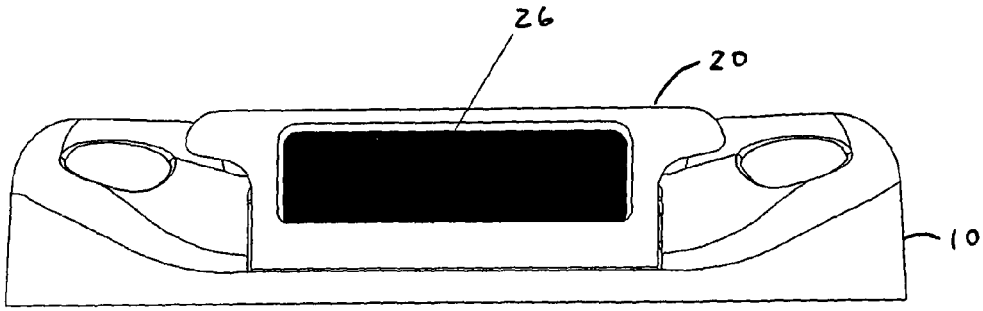
FIG. 4C is a side view of the sash lock in a latched position.
Figure 4B:
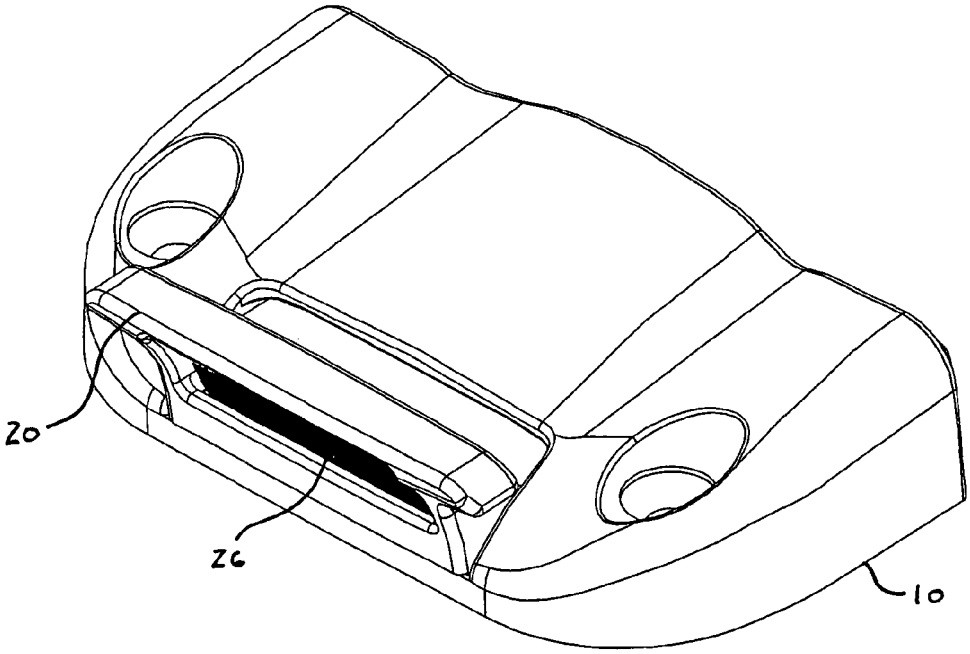
FIG. 4B is a top view of the sash lock in a latched position.
Figure 4D:
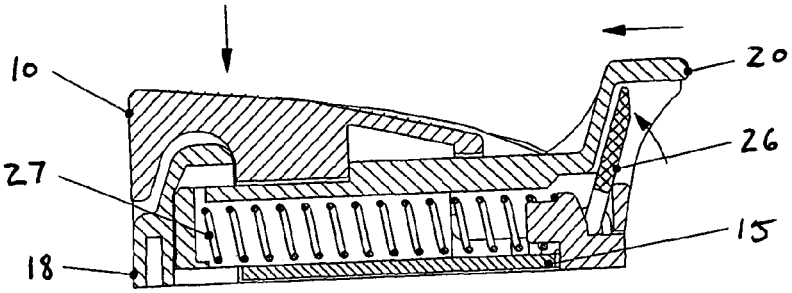
FIG. 4D is a cut away view of the spring arrangement for the sash lock.
Figure 5A:
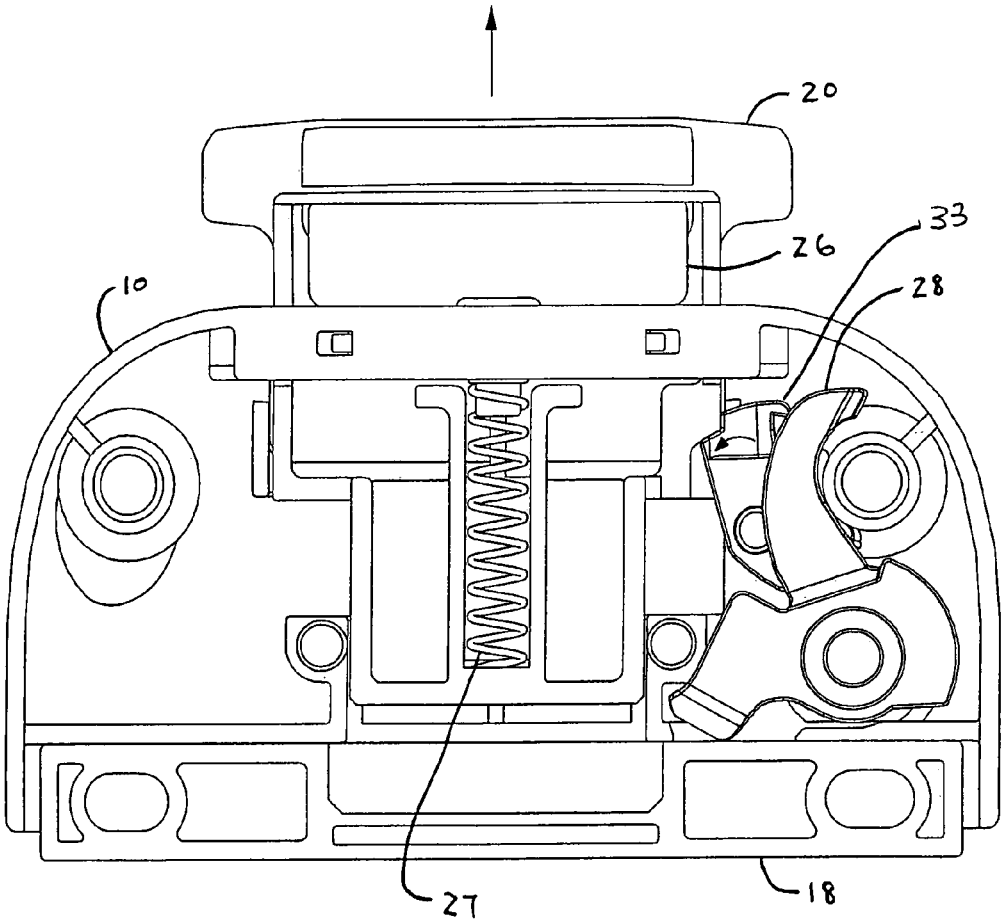
FIG. 5A is an underside view of the sash lock and keeper in an unlocked position.
Figure 5B:
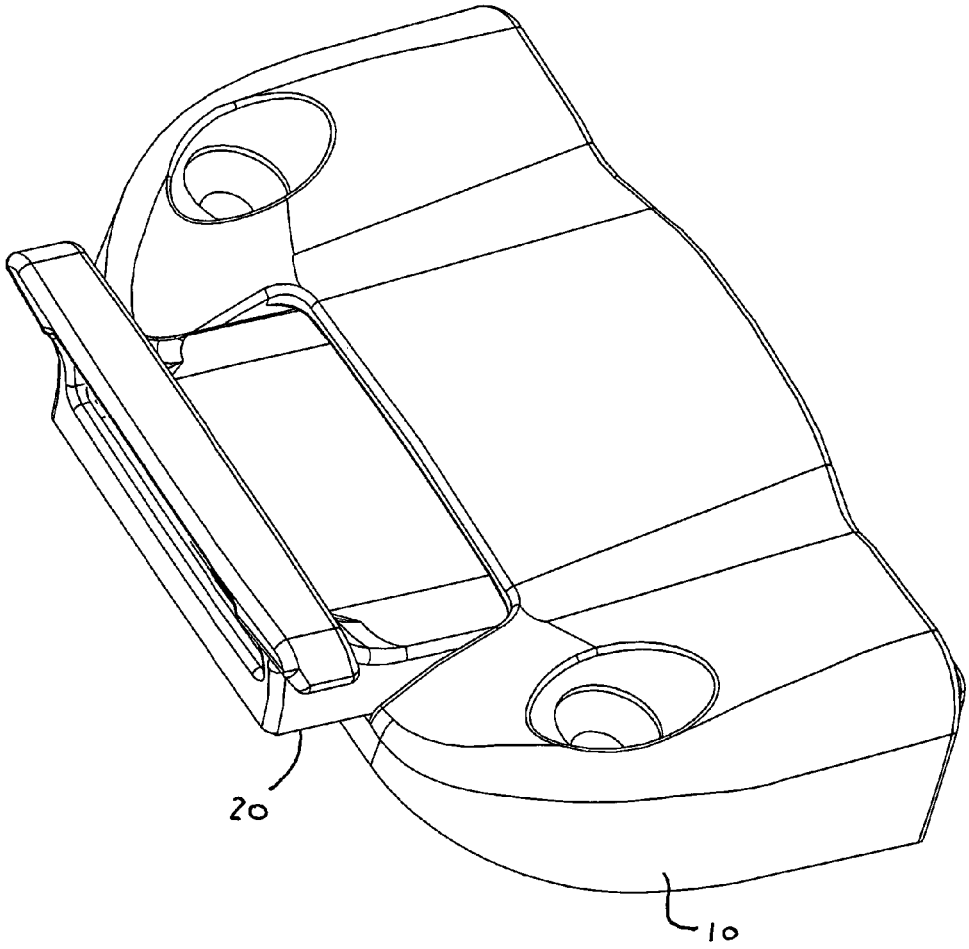
FIG. 5B is a top view of the sash lock of FIG. 5A.
Figure 5C:
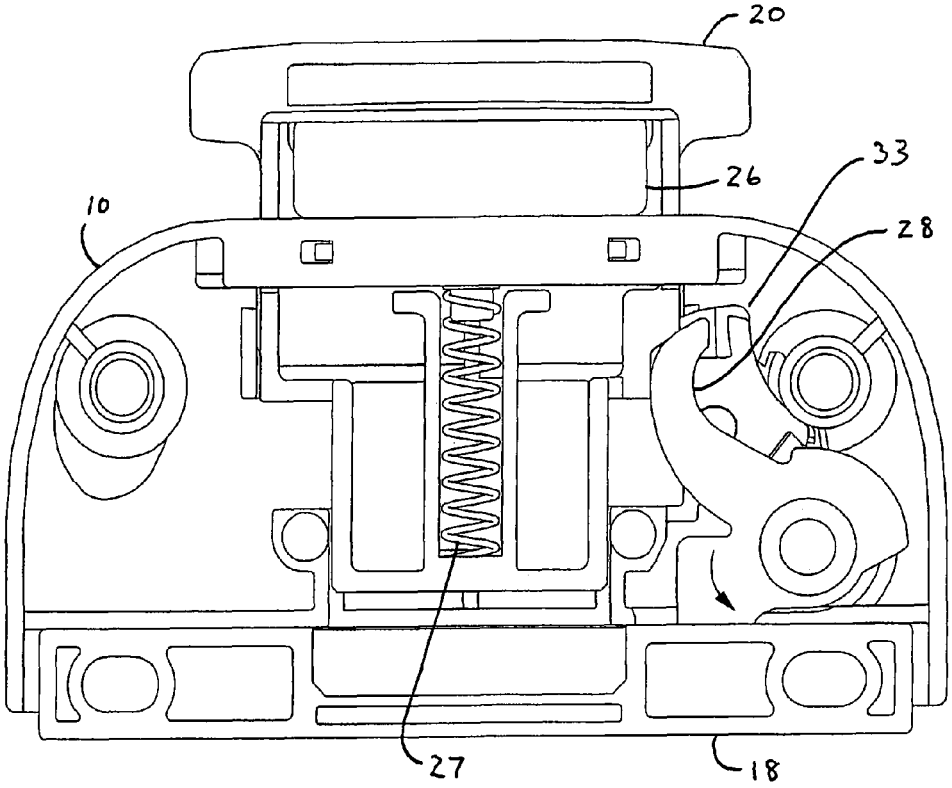
FIG. 5C is an underside view of the sash lock and keeper in an unlocked position where the keeper is separated from the sash lock.
Figure 5D:
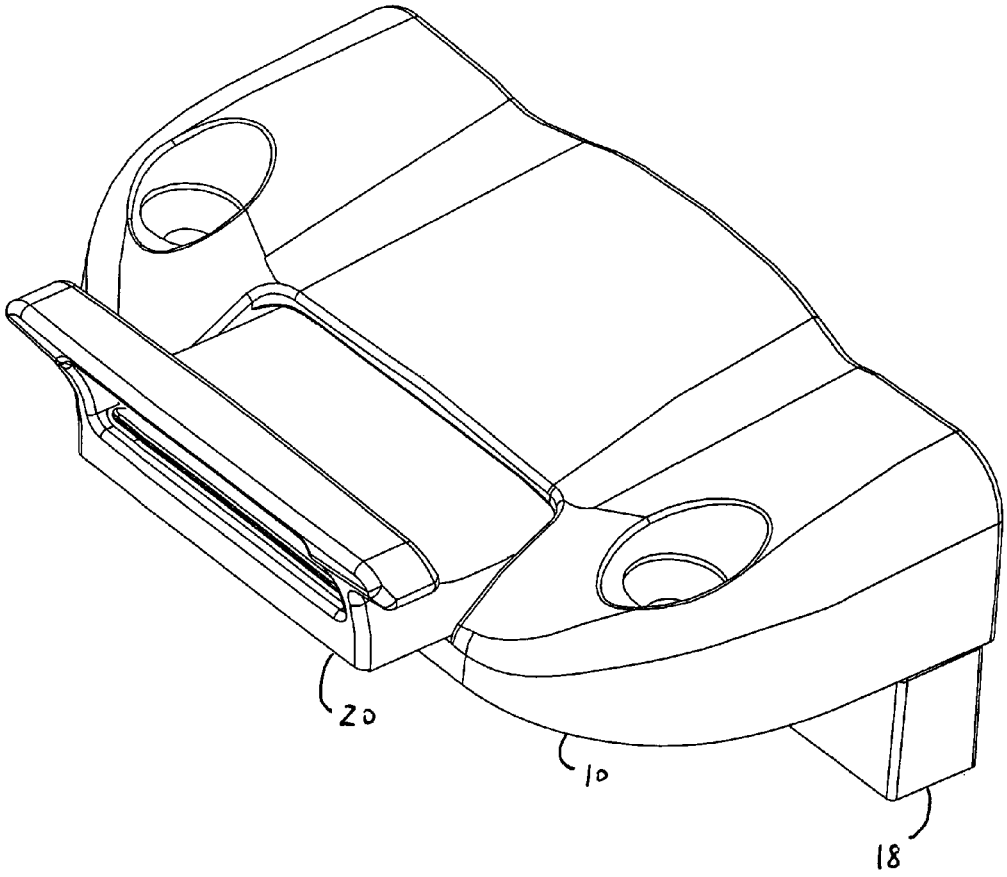
FIG. 5D is a top view of the sash lock of FIG. 5C.
Figure 6A:
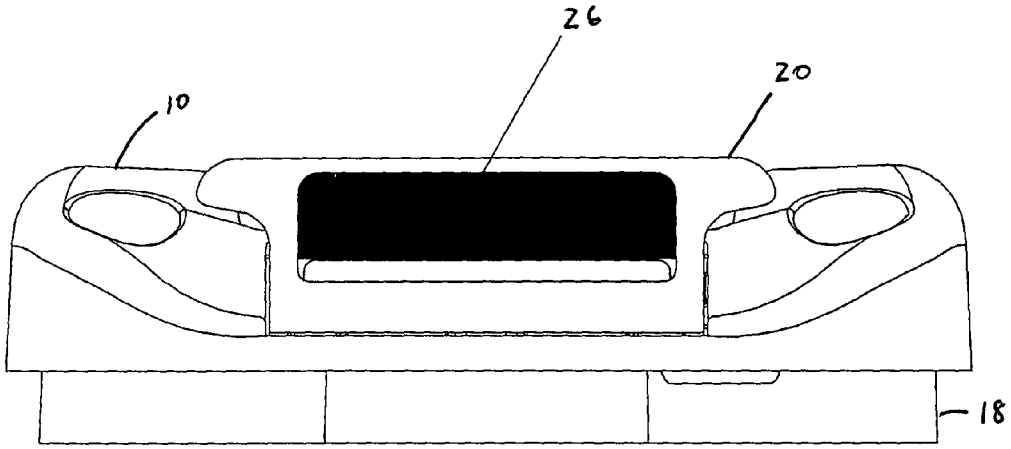
FIG. 6A is an end view of the sash lock and keeper of FIG. 5C.
Figure 6B:
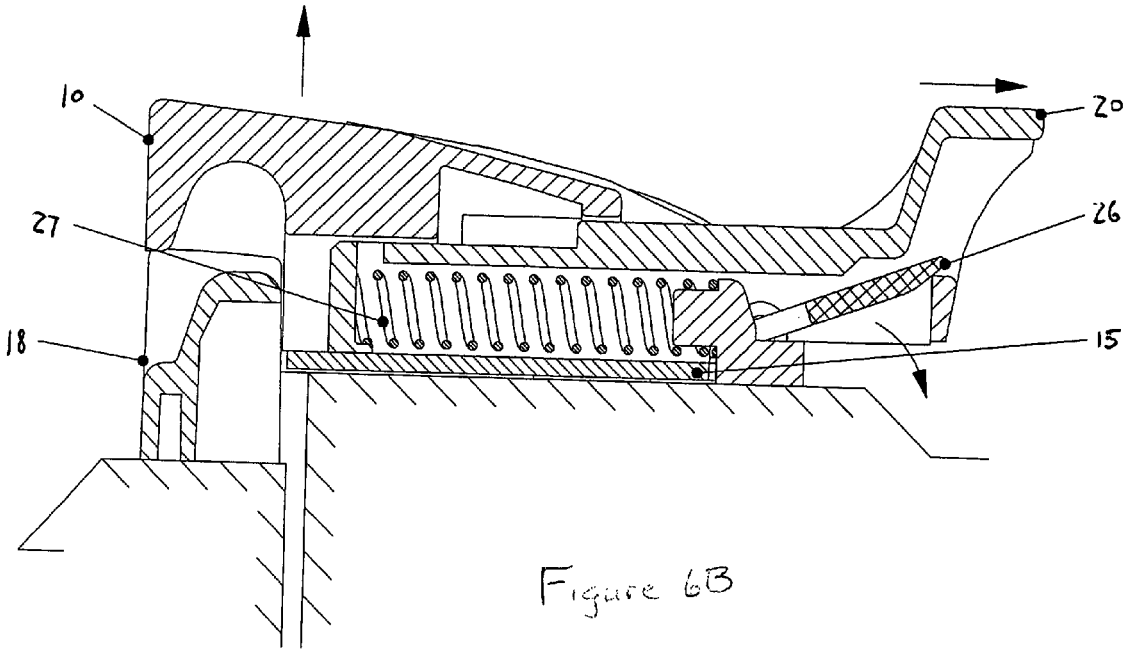
FIG. 6B is a cut away view of the sash lock and keeper of FIG. 5C.

In a preferred embodiment of the present invention, the pull tab 20 has a signal means 26 for signaling that the sash lock is in a locking arrangement or an unlocked position. In this embodiment the pull tab 20 has a handle 24. The handle 24 permits a user to grasp the pull tab 20 and reload the tongue 23 so that it can be released by the trigger. The grasping portion of the handle may be provided with one or more wings 61 and 62 that extend outwardly from the sidewall of the handle. In a preferred embodiment, the handle has a top surface and a pair of wings that extend from the top surface 63. The handle may have first and second sidewalls 64 and 65 extending from the top surface. These sidewalls connect with a base portion at the rear of the pull tab. The top surface, sidewalls and base portion 66 form a signal 67 area. The signal area has an indicator which informs a user whether the tongue is in an extended position or a recessed position. As seen in FIG. 3, the indicator is a card or sheet 70 having a top edge 71, a bottom edge 72 and a pair of side edges 73 and 74. The card is preferably hinged and has a pair of hinges 75 and 76. The front face 77 of the card is one color and the rear face 78 is a second color. When the pull tab 20 is pulled back the one face is shown. When the tongue is released, the second face is shown. Alternatively, when the pull tab 20 is pulled back, the indicator card 70 pivots downward to expose the rear surface of the pull tab, which may be a first indicator color (see FIG. 6B); and when the tongue is released, the indicator card 70 is caused to pivot upward to block the first indicator color on the rear surface of the pull tab, thereby exposing a second indicator color on the back side of the card 70 (see FIG. 4D). In a preferred embodiment, there is a red indicator that alerts the user that the tongue is recessed and thus the window is open. Another color such as white can be used to indicate that the tongue of the sash lock is in an extended condition.

FIG. 12-15 show an alternate embodiment of the sash lock and keeper of the present invention. The operation of the sash lock and keeper is similar to the Embodiment of FIG. 1-11. The actuator is however slightly different. There is a spring connection 60 between the extreme ends of the trigger 28A. The trigger has a pair of recesses for receiving the spring connection 60. The spring connection 60 puts pressure on the engagement arm 30 to keep it in position as it pivots.

We claim:

1. An automatic sash lock comprising:

a housing, said housing having a top surface and a bottom surface and one or more side surfaces extending from said top surface, said housing having a front face at least a portion of which is open to the interior of the housing;

a tongue being slidably received by said housing;

a first spring, said first spring biasing said tongue to move from a retracted position into an extended position wherein a portion of said tongue extends out from said open area of said front face of the housing; and wherein when said tongue is in said retracted position, said sash lock is in an open configuration, and when said tongue is in said extended position, said sash lock is in a locked configuration;

an activator arm, said activator arm being pivotally mounted in said housing;

a trigger, said trigger being pivotally mounted in said housing;

a second spring, said second spring biasing said trigger to pivot relative to said activator arm to have a portion of said trigger protruding from said housing when said tongue is in said retracted position, said second spring thereby biasing a portion of said activator arm towards said tongue, said portion of said activator arm being configured to engage said tongue and restrain movement of said tongue against said biasing of said first spring when said tongue is moved from said extended position into said retracted position; and wherein said tongue automatically moves from said retracted position to said extended position when said portion of said trigger protruding from said housing is actuated against said biasing of said second spring to cause a portion of said trigger to releasably catch upon said portion of said activator arm and cause said activator arm to pivot and thereby release said engagement with said tongue.

2. The sash lock according to claim 1 wherein said second spring comprises a torsion spring.

3. The sash lock according to claim 2 wherein said first spring comprises a helical compression spring.

4. An automatic sash lock comprising: a housing, said housing having a top surface and a bottom surface and a front surface and one or more side surfaces extending from said top surface at least a portion of said front surface of said housing having an opening into the interior of said housing, said housing having a tongue being slidable therein with a graspable pull tab extending from said tongue, said tongue being slidable between a second position and a first position by moving said pull tab, said tongue being biased from said second position toward said first position by a first spring, a portion of said tongue protruding out from said opening in said housing when said tongue is in said second position, and wherein when said tongue is in said first position, said sash lock is in an open configuration, and when said tongue is in said second position, said sash lock is in a locked configuration;

said tongue being releasably retained in said first position by an activator arm, until said activator arm is engaged by a trigger, said trigger being pivotally mounted in said housing and said activator arm being mounted in said housing, said trigger being biased to pivot relative to said activator arm by a second spring to have a portion of said trigger protruding from said housing when said tongue is in said first position, said relative biasing by said second spring thereby biasing a portion of said activator arm towards said tongue, said portion of said activator arm being configured to engage said tongue and restrain movement of said tongue against said biasing of said first spring when said tongue is moved from said second position into said first position; and wherein said tongue automatically moves from said first position to said second position when said portion of said trigger protruding from said housing is actuated against said biasing of said second spring to cause a portion of said trigger to releasably catch upon said portion of said activator arm and cause said activator arm to pivot and thereby release said engagement with said tongue, said sash lock comprising an indicator sheet being pivotally mounted to said housing, said indicator sheet being configured to pivot away from a rear surface of said pull tab to expose a first color on said rear surface of said pull tab to signal when said tongue is in said second position; and said indicator sheet being configured to pivot to block said first color on said rear surface of said tongue and expose a different indicator color being on said indicator sheet to signal when said tongue is in said first position, said indicator sheet being pivotally attached to said housing using a pair of hinges.

5. The sash lock according to claim 4 wherein said indicator sheet is a generally rectangular sheet having a top edge, a bottom edge and two side edges.

6. The sash lock according to claim 5 wherein said different indicator color on said indicator sheet comprises a red color.

* * * * *